US011499799B2

(12) United States Patent
Self

(10) Patent No.: US 11,499,799 B2
(45) Date of Patent: Nov. 15, 2022

(54) PISTOL MOUNT ASSEMBLY

(71) Applicant: Ferlon Self, Derrider, LA (US)

(72) Inventor: Ferlon Self, Derrider, LA (US)

( * ) Notice: Subject to any disclaimer, the term of this patent is extended or adjusted under 35 U.S.C. 154(b) by 0 days.

(21) Appl. No.: 17/238,087

(22) Filed: Apr. 22, 2021

(65) Prior Publication Data

US 2021/0333064 A1 Oct. 28, 2021

Related U.S. Application Data

(60) Provisional application No. 63/013,798, filed on Apr. 22, 2020.

(51) Int. Cl.
*F41C 33/02* (2006.01)

(52) U.S. Cl.
CPC ..... *F41C 33/0245* (2013.01); *F41C 33/0263* (2013.01)

(58) Field of Classification Search
CPC ..... F41C 33/00; F41C 33/02; F41C 33/0236; F41C 33/0245; F41C 33/0263; F41C 33/0272; F41C 33/041; F41C 33/048
See application file for complete search history.

(56) References Cited

U.S. PATENT DOCUMENTS

| | | | | |
|---|---|---|---|---|
| 4,377,249 | A * | 3/1983 | Bockoven | A44B 11/005 224/163 |
| 5,458,266 | A * | 10/1995 | Pichot | F41C 33/0263 224/244 |
| 6,616,020 | B1 * | 9/2003 | Spielberger | F41C 33/0245 224/183 |
| 8,302,827 | B1 * | 11/2012 | Cole | F41C 33/0263 224/243 |
| 9,297,612 | B2 * | 3/2016 | Schmadeka | F41C 33/0209 |
| 10,077,968 | B2 * | 9/2018 | Liang | F41C 33/0272 |
| 10,302,392 | B2 * | 5/2019 | Waters | H01F 7/0252 |

* cited by examiner

*Primary Examiner* — Corey N Skurdal
(74) *Attorney, Agent, or Firm* — Law Office of Jeff Williams PLLC; J. Oliver Williams

(57) ABSTRACT

A pistol mount assembly includes a clip body, a retaining body, a latch assembly and a locking cylinder. The clip body secures the retaining body to a person or object. The retaining body is optionally removable from the clip body and includes the latch assembly and the locking cylinder. At least one of the latch assembly and the locking cylinder pass within a trigger guard area of the firearm. The space between the trigger guard and the trigger is filled thereby preventing misfire. One or more latches or locking bolts are used to selectively overlap the trigger guard and/or trigger to prevent translation of the firearm off the retaining body. A two-tiered readiness function is realized through the pistol mount assembly. The assembly uses no holster but maintains effective securement of the firearm and is easily pulled at time of emergency.

18 Claims, 10 Drawing Sheets

PISTOL MOUNT ASSEMBLY

CROSS REFERENCE TO RELATED APPLICATIONS

This application claims the benefit of an earlier filing date and right of priority to U.S. Provisional Application No. 63013798, filed 22 Apr. 2020, the contents of which is incorporated by reference herein in its entirety.

BACKGROUND OF THE INVENTION

1. Field of the Invention

The present application relates to a locking device, and more particularly to a locking device used to secure a firearm to a user while preventing activation of the trigger.

2. Description of Related Art

The art to which the invention relates, therefore, includes trigger locks, cable locks, breech locks and other devices designed to effectively disable the working mechanisms of a firearm to prevent its discharge. Such devices are commonly used in conjunction with firearms such as pistols, revolvers, and rifles to safely disable the firearm and prevent children or other individuals unable to appreciate the consequences of discharging a firearm from doing so.

In the case of trigger locks, the lock generally overlies the trigger guard as well as the trigger of the firearm. When the trigger lock mechanism is operably attached to a firearm, it obstructs a user's access to the trigger mechanism and cannot be removed from the firearm without a key to disengage it therefrom. Thus, when the trigger lock is engaged and attached to a firearm, a user is prevented from squeezing the trigger. The trigger lock covers the trigger and trigger guard on both sides of the gun. With this lock, it is difficult to store the firearm in a holster and in fact requires a separate container for storage. In an emergency these locks are slow to detach.

Cable locks and breech locks are designed to prevent the operation of the firearm by preventing the firearm from being placed in the "cocked" and ready to fire position. For example, a cable lock is designed to engage the action of a pistol or cylinder of a revolver and prevent it from chambering a cartridge to be fired. Similarly, a breech lock prevents a cartridge from being chambered by blocking the open end of the barrel, often referred to as the chamber or bore, and thus preventing a cartridge from being placed in the ready to fire position.

One common drawback associated with all of the aforementioned locks is the inability of such locks to hold a firearm securely within a holster. In addition, this results in the inconvenience of having a separate safety and storage device. Another common problem associated with such locks is an apparent inability to disengage the firearm lock rapidly. For example, in an emergency situation where a firearm is needed to repel an intruder, or in the law enforcement environment where a peace officer is apprehending a criminal, a trigger lock mechanism of the aforementioned type would prevent quick access to the weapon to repel the attack or stop the crime. Thus, trigger lock mechanisms of this type are believed to be impractical for situations in which quick access to the firearm is required.

It is common for firearm owners to want to put the pistol in a holster for storage because they use the holster for carrying the firearm. However, another well-known problem is the need of using a holster. Solutions for locking devices purport to be solutions because it may be suitable for a holster. But when the time comes to need it, the mere act of having to withdraw the firearm from the holster is a hinderance.

When needed, the speed at which a user can withdraw their firearm and be ready is pivotal. Locking devices either deactivate the gun or shroud over the weapon necessitating longer readiness times. The need to carry the firearm securely also in a holster also adds to the readiness time of the firearm.

Thus, it would be advantageous to provide a holster and locking mechanism capable of engaging the trigger and trigger guard of a firearm to Securely constrain the firearm within the holster, and yet have it accessible in an emergency situation merely by disengaging the lock component of the holster freeing the firearm for use.

Although strides have been with locking devices for firearms, shortcomings remain. It is desired that a pistol mount assembly be provided that provides a two-tiered readiness function without shrouding over the firearm all while permitting quick draw capabilities.

BRIEF SUMMARY OF THE INVENTION

It is an object of the present application to provide a holster and locking mechanism capable of engaging the trigger and trigger guard of a firearm to securely constrain the firearm within the holster, and yet have it accessible in an emergency situation merely by disengaging the lock component of the holster freeing the firearm for use. The pistol mount assembly provides a two-tiered readiness function without shrouding over the firearm all while permitting quick draw capabilities.

Ultimately the invention may take many embodiments. In these ways, the present invention overcomes the disadvantages inherent in the prior art. The more important features have thus been outlined in order that the more detailed description that follows may be better understood and to ensure that the present contribution to the art is appreciated. Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present design. It is important, therefore, that the claims be regarded as including such equivalent constructions insofar as they do not depart from the spirit and scope of the present application.

BRIEF DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
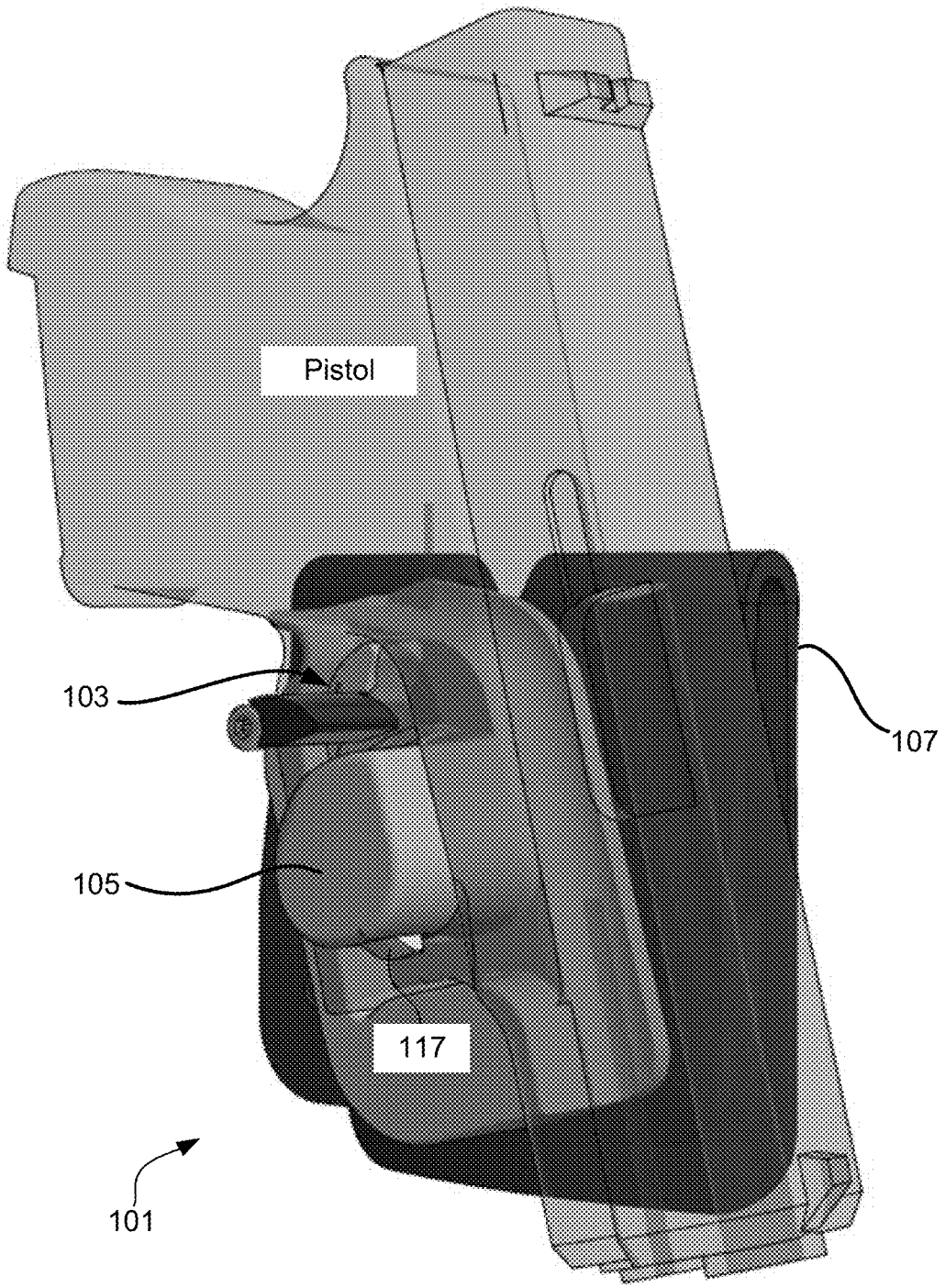
FIG. 1 is a perspective view of a pistol mount assembly according to an embodiment of the present application.

While the embodiments and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE INVENTION

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

The embodiments and method in accordance with the present application overcomes one or more of the above-discussed problems commonly associated with the prior art discussed previously. The pistol mount assembly of the present application is configured to provide at least the following key features: 1) permit increased readiness times for the firearm, 2) simultaneously provide holstering capabilities while avoiding the shrouding effect of a holster, 3) allowing the firearm to be withdrawn from the assembly by translating the firearm laterally, 4) removing bulk from the securing device, and 5) permitting a two-tiered readiness function by allowing full locking capability and a restraining capability without full locking effect. These and other unique features are discussed below and illustrated in the accompanying drawings.

The embodiments and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

Referring now to the Figures wherein like reference characters identify corresponding or similar elements in form and function throughout the several views. The following Figures describe embodiments of the present application and its associated features. With reference now to the Figures, embodiments of the present application are herein described. It should be noted that the articles "a", "an", and "the", as used in this specification, include plural referents unless the content clearly dictates otherwise.

Figure 2:
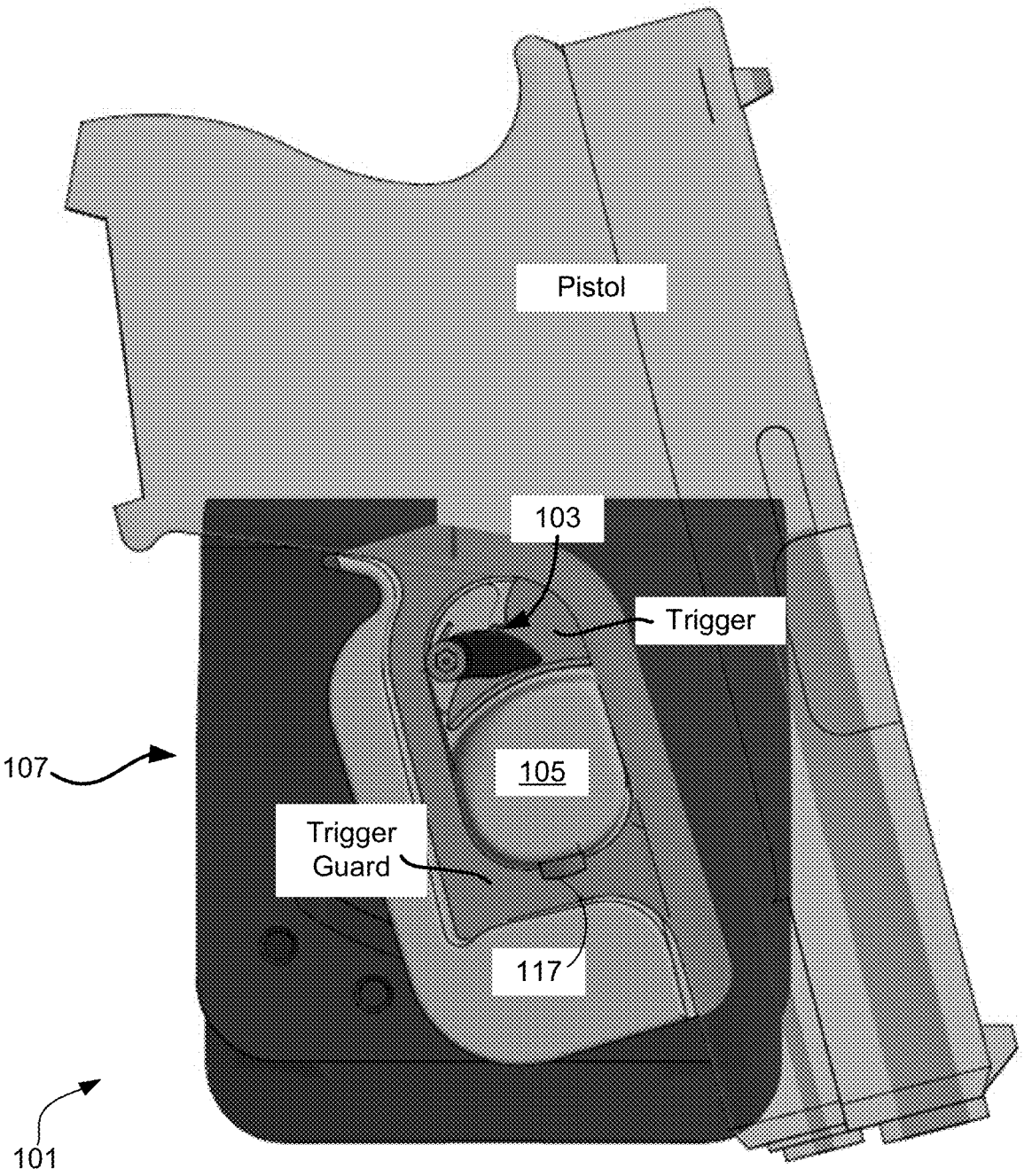
FIG. 2 is a front view of the pistol mount assembly of FIG. 1.

Referring now to FIGS. 1 and 2 in the drawings, a perspective view and front view of the pistol mount assembly 101. Assembly 101 is configured to secure the trigger of a firearm, such as a pistol. Assembly 101 is configured to provide a two-tiered readiness function/capability for the firearm. The firearm is able to be securely held without a holster and is configured to provide quick withdrawal when needed in an emergency.

During a first tiered readiness function the trigger is prevented from moving as it is sandwiched between members that pass within the trigger guard area. The firearm is secured to the user about the trigger. For removal and use of the firearm, the user merely has to laterally slide the firearm out away from body 107. This distance is greatly smaller than the distance necessary to remove a firearm from a holster. This quickens the readiness of the firearm. During a second tiered readiness function/capability a locking bolt is extended outward so as to prevent lateral motion of the firearm away from the clip.

Referring now also to FIGS. 3-9 in the drawings, views of assembly 101 are presented. Assembly 101 includes a clip body 107, a latch assembly 103, and a locking cylinder 105. Clip body 107 is configured to permit for the holstering or carrying of the firearm without the need of an actual holster. Body 107 is a slender and rigid mechanism to mount the locking mechanism to a user. As noted previously, a holster is not required. Removal of the holster provides at least a couple benefits. First, the bulkiness of the overall carrying device (i.e. holster), the locking mechanism, and the firearm is greatly reduced. Secondly, the readiness level of the firearm is greatly increased. Absence of a holster means that a user does not have to withdraw the firearm from the holster and also then "activate" the firearm.

Clip body 107 is a singular body which is folded over on itself creating a flexing tension at the fold. The inner member 107*a* is opposite the outer member 107*b*. Members 107*a* and 107*b* are configured to flex at a more increasingly level farther from the fold. A compressive force is exerted by the members 107*a*/107*b* onto a material placed therebetween, such as a belt, outerwear clothing, or a pocket of a bag to name a few. It is understood that many types or styles may exist for body 107 and that only one such style is shown. A tooth 110 may be included to help clip body 107 grasp onto any material therebetween. Body 107 has the foremost capacity to locate the locking mechanism opposite the side of body 107 adjacent the user or mounted surface. Additionally, it is preferred that body 107 be simple, streamlined/slender/thin in its design, and light weight.

Assembly 101 further includes a retaining body 104 that extends out from outer member 107*b* and is used to engage the firearm. Retaining body 104 may be integrally formed onto clip body 107 in some embodiments. In other embodiments the retaining body 104 is detachable wherein it may be interchanged to adapt to different styles of firearms. This allows the clip body 107 to be retained the user for different styles of firearms. Fasteners 116 may be used to secure retaining body 104 to clip body 107 when interchangeability is permitted (see FIG. 7). The retaining body 104 includes the latch assembly 103 and locking cylinder 105.

Assembly 101 passes internally within the trigger guard of the firearm and sandwiches a portion of the trigger between a latch 103*a* and a locking cylinder 105. Latch assembly 103 includes latch 103*a* and a rotating latch 103*b*. Latch 103*a* is contoured to match that of the trigger and passes behind the trigger. Cylinder 105 also passes within the trigger guard but is oriented to be in front of the trigger. A trigger channel 112 is formed therebetween. A user is prevented from locating their finger on the trigger from the presence of cylinder 105. The trigger cannot be depressed due to the presence of latch 103*a*. Another benefit of latch 103*a* is that it prevents a user from even cocking the hammer of the firearm as movement of the trigger is restricted.

A guard channel 114 is formed in retaining body 104 wherein it passes outside that of latch assembly 103 and locking cylinder 105. The trigger guard of the firearm rests within guard channel 114 while the trigger rests in trigger channel 112. When fully seated within both channels 112/114, the firearm is stable. A compressive force may be exerted by latch 103*a* to pinch the trigger against the locking cylinder. Latch 103*a* may be configured to flex in such conditions or remain rigid in other embodiments.

Figure 3:
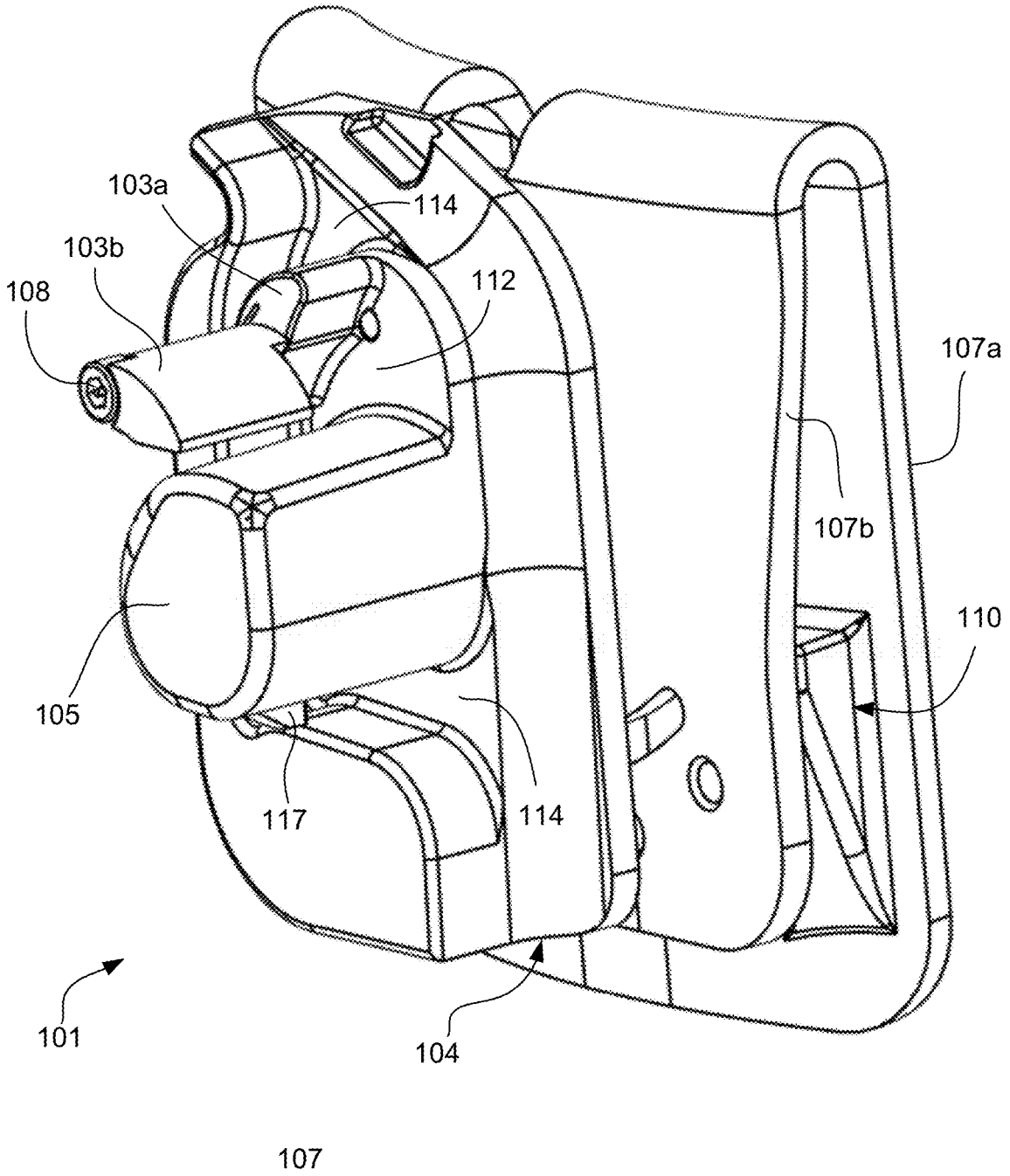
FIG. 3 is an enlarged perspective view of the pistol mount assembly of FIG. 1.

Latch assembly 103 may further include a rotating tear drop latch 103*b*. Rotating latch 103*b* is located at a distal end of latch 103*a*. Rotating latch 103*b* is configured to rotate about an axis concentric with a fastener 108 which is used to secure rotating latch 103*b* to latch 103*a*. Rotating latch 103*b* is configured to selectively rotate so as to extend over trigger channel 112 in one orientation or rotate away from (i.e. withdraw from) trigger channel 112 so as to not overlap it. As seen in FIG. 3, rotating latch 103*b* is rotated so as to overlap trigger channel 112. When rotating latch 103*b* overlaps channel 112, the firearm is prevented from sliding out of retaining body 104.

Figure 6:
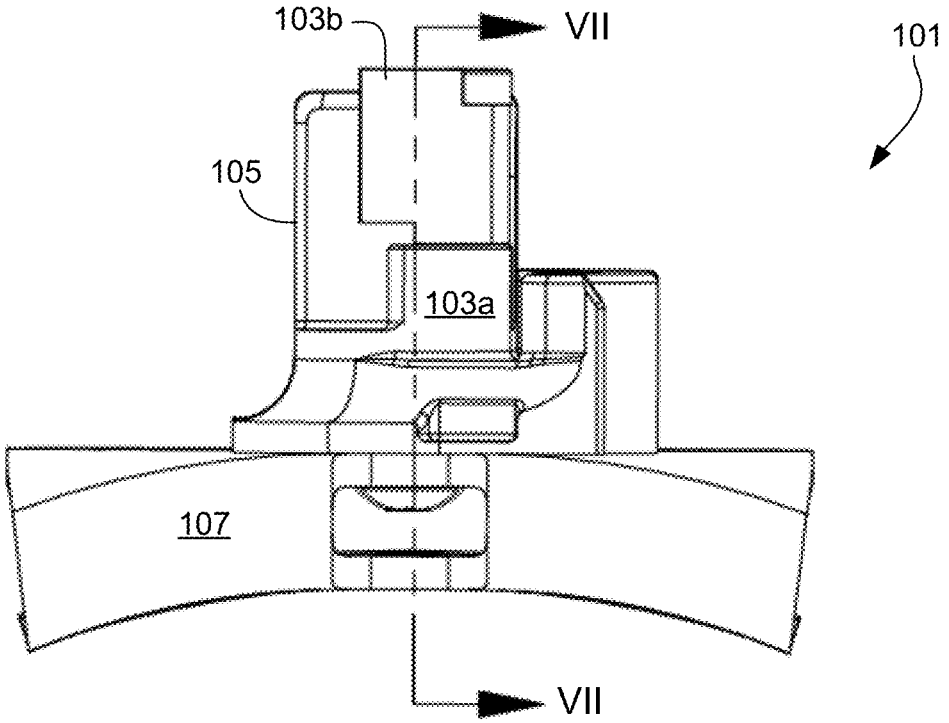
FIG. 6 is a top view of the pistol mount assembly of FIG. 3.
Figure 7:
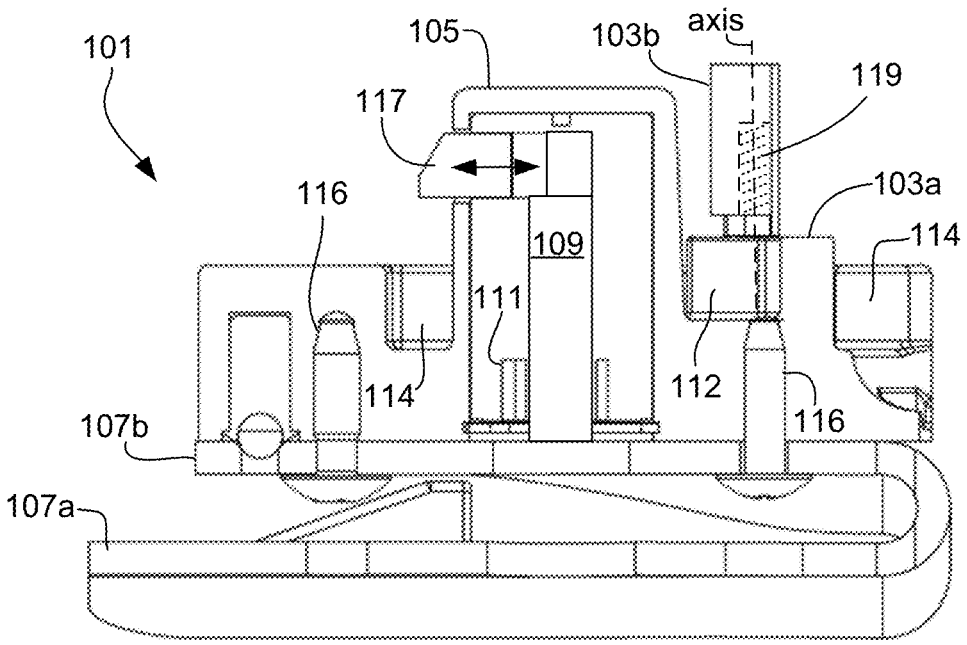
FIG. 7 is a side section view of the pistol mount assembly of FIG. 6.
Figure 8:
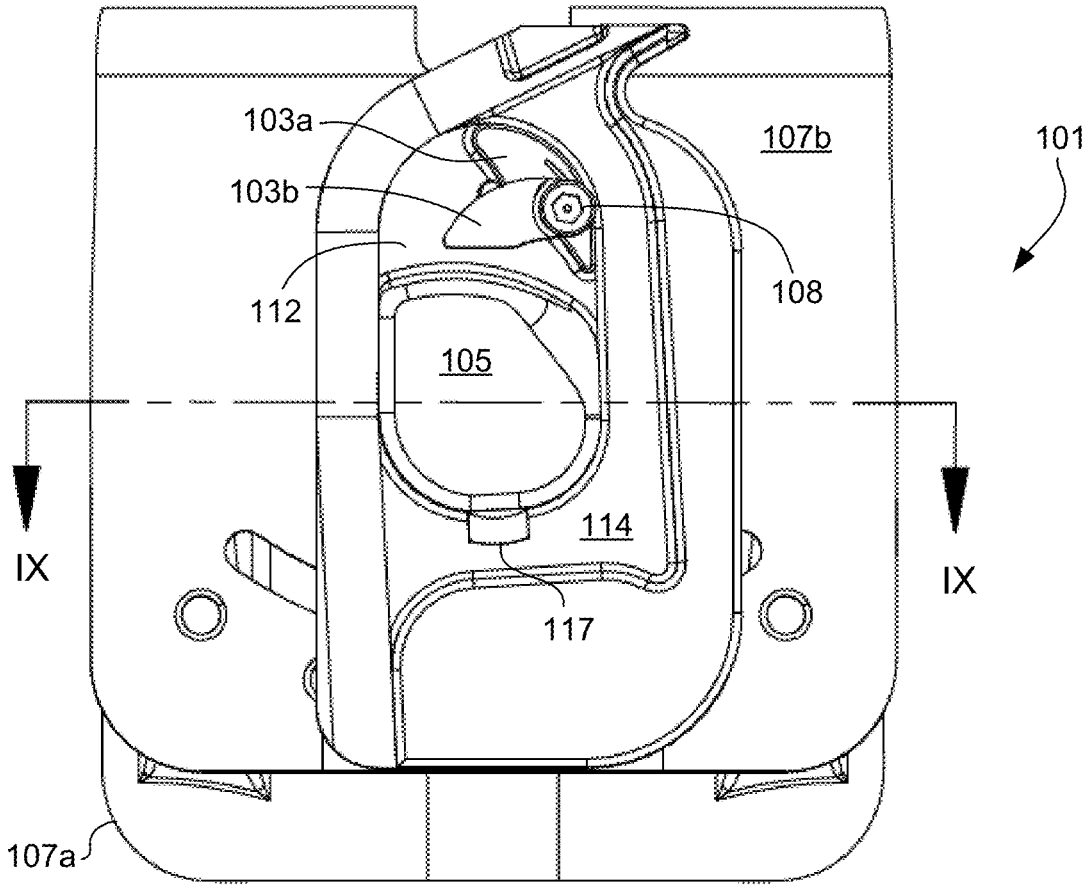
FIG. 8 is a front view of the pistol mount assembly of FIG. 3.
Figure 9:
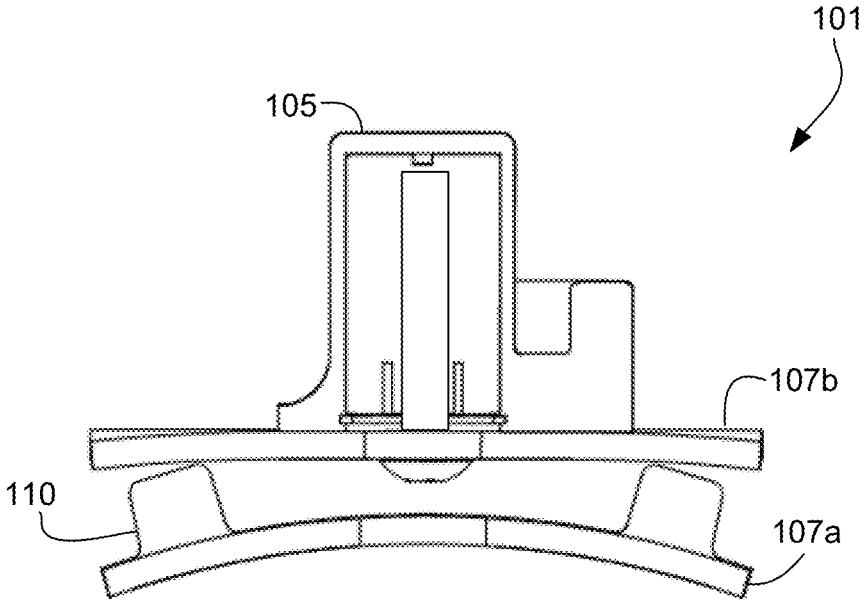
FIG. 9 is a section view of the pistol mount assembly of FIG. 8.
Figure 10:
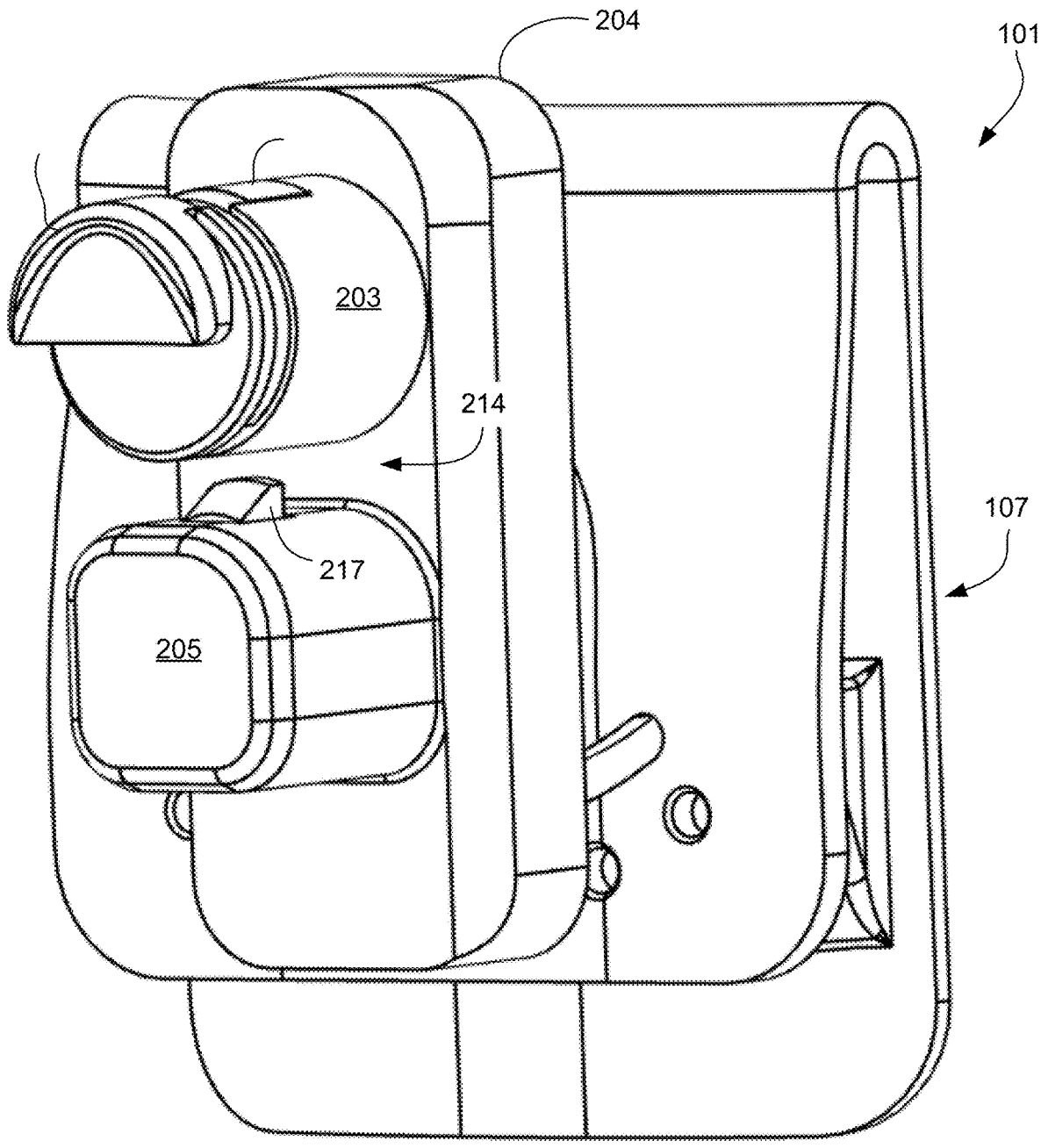
FIG. 10 is an alternate embodiment of the pistol mount assembly of FIG. 3.
Figure 11:
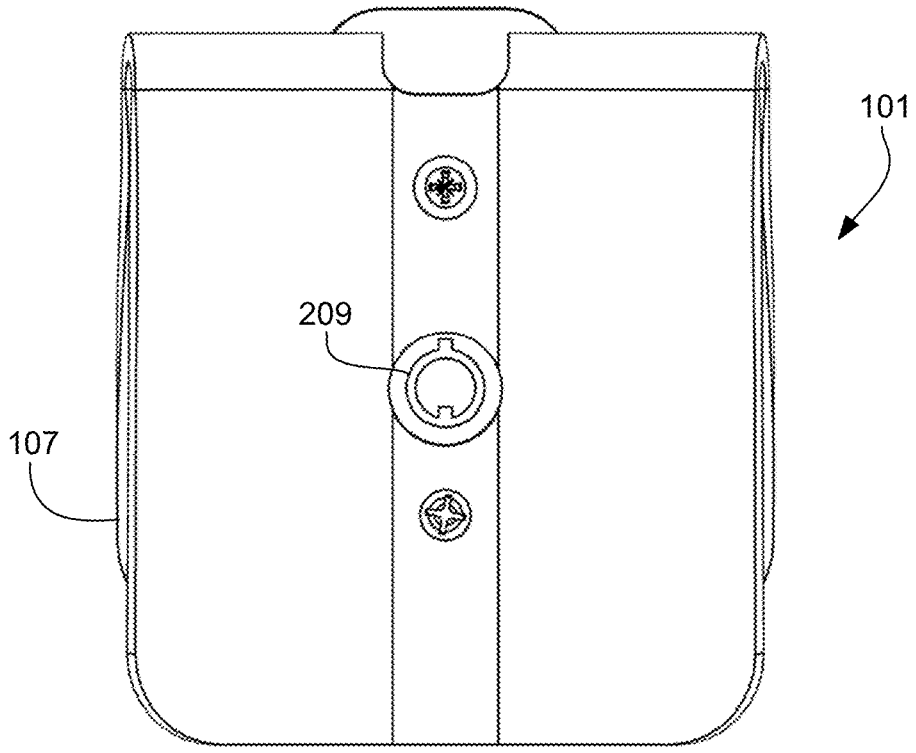
FIG. 11 is a rear view of the pistol mount assembly of FIG. 10.

A section view of assembly 101 is shown in FIG. 7 as taken from FIG. 6. Within FIG. 7, it is viewable to see a tensioning device 119 in communication with rotating latch 103*b*. In this embodiment, tensioning device 119 is internal to rotating latch 103*b* and is configured to position rotating latch 103*b* are a set orientation when at rest. A user may optionally be able to re-orient latch 103*b* so as to rotate to the other orientation. At rest, rotating latch 103*b* extends over trigger channel 112 in this embodiment. Rotating latch 103*b* overlaps the trigger and prevent withdrawal of the firearm without first manually rotating the latch 103*b*. In use, the user withdraws the firearm laterally away from clip body 107 by first rotating the latch 103*b*. Tensioning device 119 is optional and rotating latch 103*b* may just have preset positions wherein a resting force from device 119 is not required. Device 119 is useful because it helps to ensure that the locking capability of assembly 101 is automatically activated when the firearm is inserted.

Figure 4:
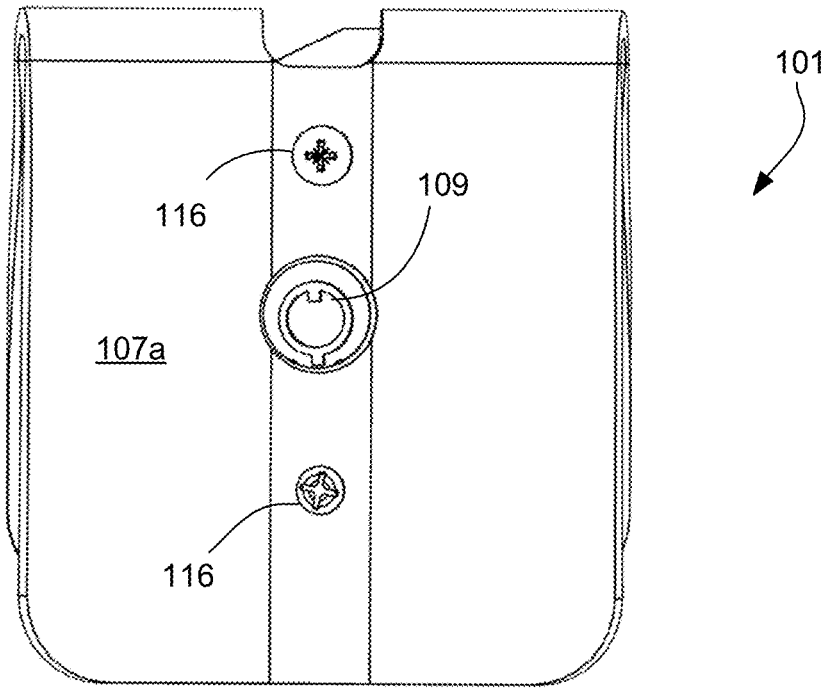
FIG. 4 is a rear view of the pistol mount assembly of FIG. 3.

A lock 109, as seen in FIG. 4, is provided to secure assembly 101 to the firearm and prevent its removal from the locking assembly of cylinder 105 and latch 103. The lock 109 is used in conjunction with the second tiered readiness function. Lock 109 may be a keyed lock through mechanical means as shown or may be done through electronic capabilities as well. Lock 109 is held in place with one or more fasteners 111. Lock 109 is located partially within locking cylinder 105 and communicates with locking bolt 117 to facilitate operation of locking bolt 117 between an extended and retracted position relative to guard channel 114.

Figure 5:
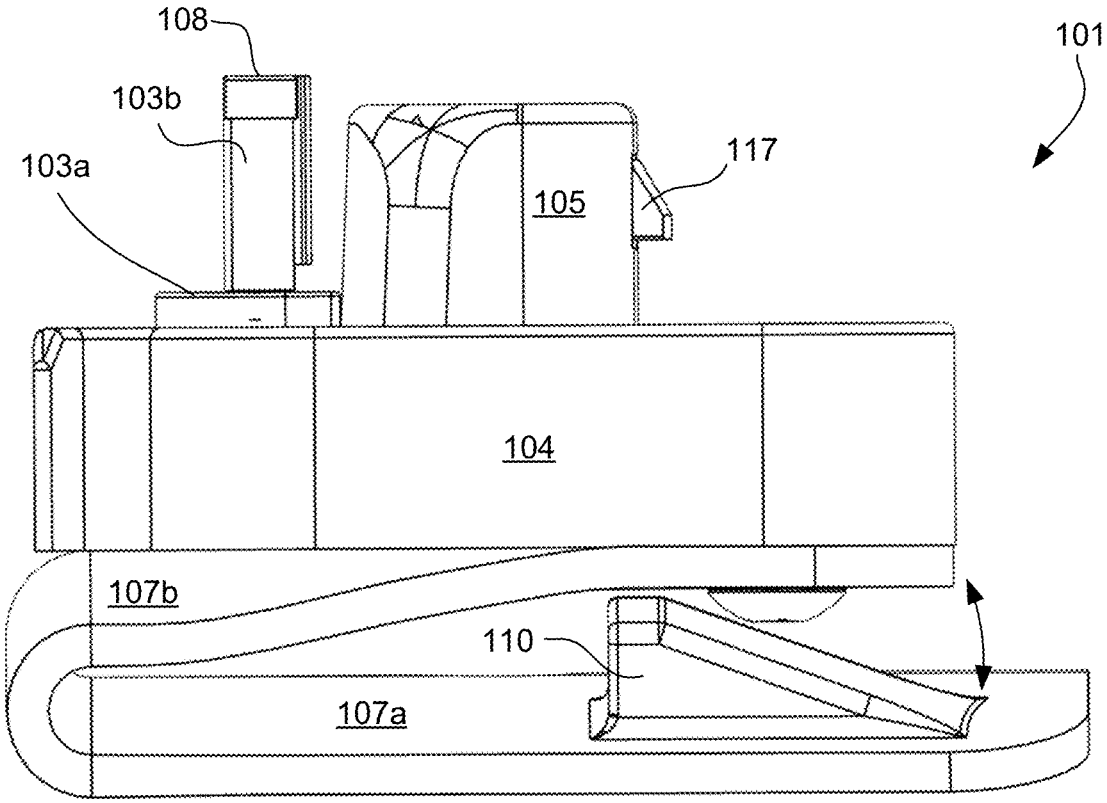
FIG. 5 is a side view of the pistol mount assembly of FIG. 3.

FIG. 5 provides a side view of pistol mount assembly 101 while FIG. 4 presented a rear view. FIG. 6 provides a top view of assembly 101 wherein a section view is taken for FIG. 7 so as to show some internal components.

The locking mechanism does not include a shroud to cover the sides of the trigger area as done with most trigger locks. The lack of any external shrouding is noticeable with assembly 101 in that the locking mechanism alone is all that is needed as it is all inserted within the confines of the trigger guard. However, the locking mechanism comes through, and internally locates itself within the confines of the trigger guard area, from a singular side.

Referring now also to FIGS. 10-16 in the drawings, an alternate embodiment of pistol mount assembly 101 is illustrated. It should be noted that some firearms do not have a space between the rear of the trigger and the firearm grip. An example of this would be a 1911 pistol. In situations like this, pistol mount assembly 201 is used and differs from assembly 101 in some small respects. Retaining body 104 may be replaced with retaining body 204 to form assembly 201. Clip body 107 is included with a different shaped retaining body 204. It is understood that the form and functions of assembly 101 are similar to that of assembly 201. A singular channel 214 is defined between a locking cylinder 205 and latch assembly 203. A portion of assembly 201 passes through the trigger guard area and engages the trigger and the trigger guard. Wherein with assembly 101, the trigger was open between itself and the grip of the firearm, this is not the case at all times (i.e. 1911 firearm).

As seen in the Figures, this embodiment of body 204 locates locking cylinder 205 outside of the trigger guard area wherein the locking bolt 217 operates toward and away from latch assembly 203. The trigger guard passes within channel 214 and locking bolt 217 is used to overlap the trigger guard. A lock 209 passes within locking cylinder 205 to operate locking bolt 217.

Figure 12:
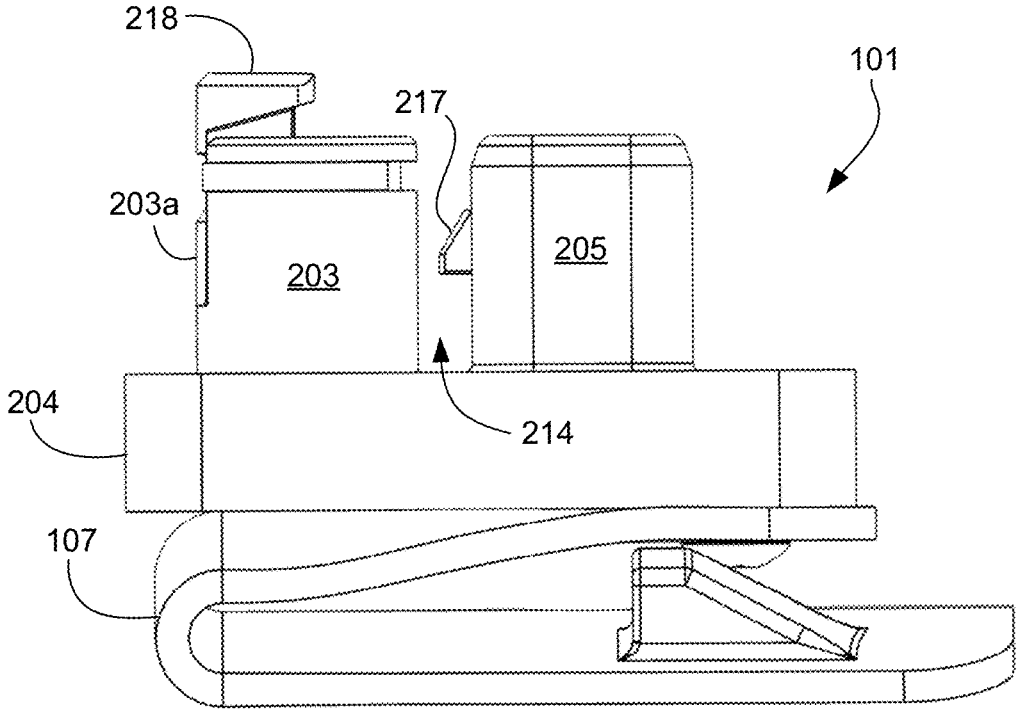
FIG. 12 is a side view of the pistol mount assembly of FIG. 10.
Figure 13:
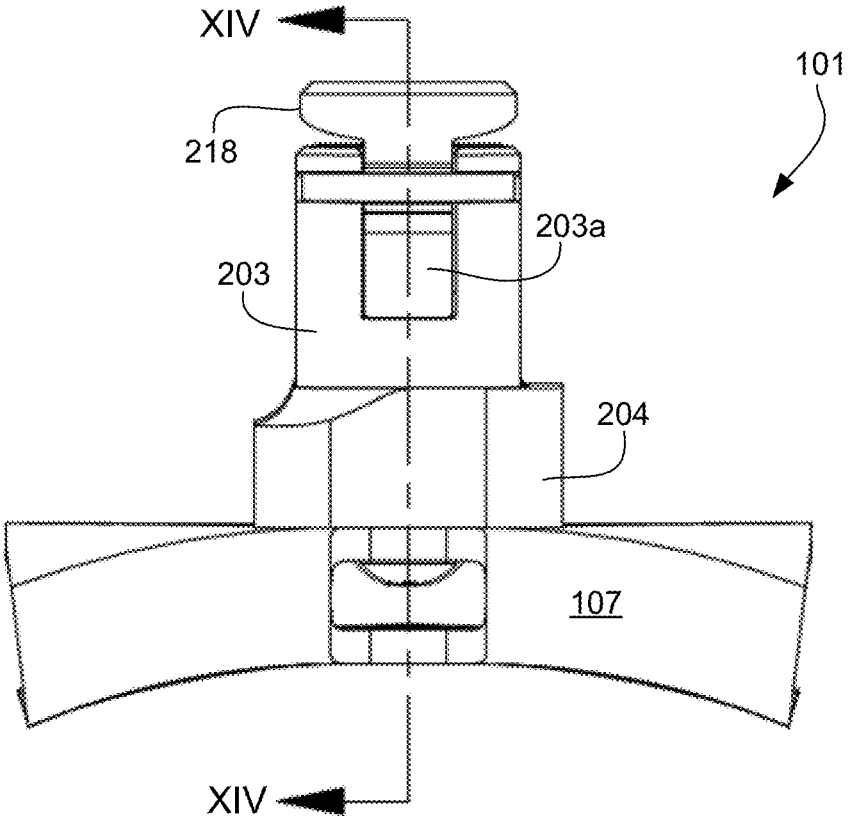
FIG. 13 is a top view of the pistol mount assembly of FIG. 10.
Figure 14:
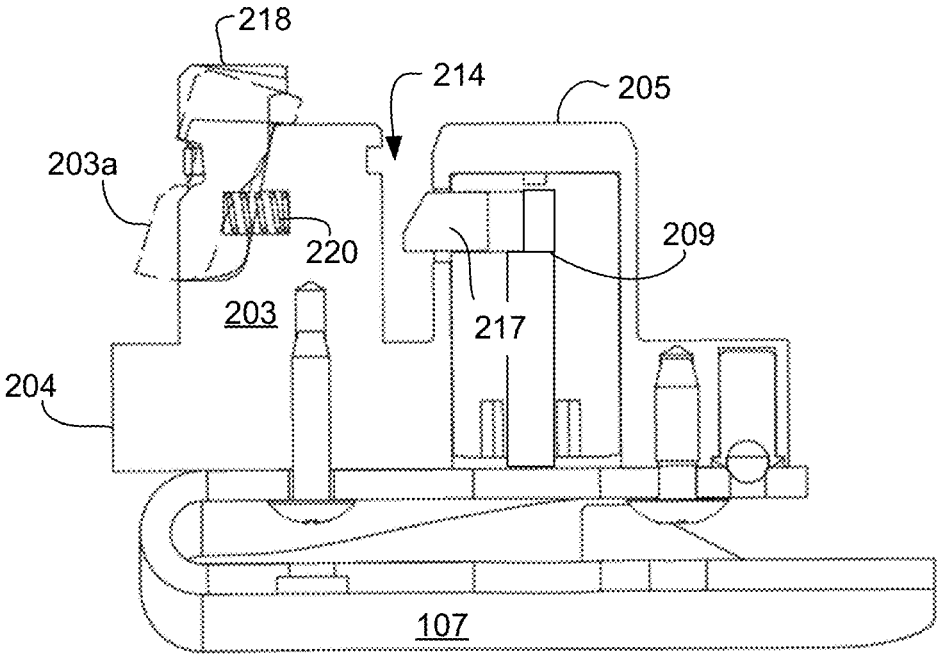
FIG. 14 is a side section view of the pistol mount assembly of FIG. 13.
Figure 15:
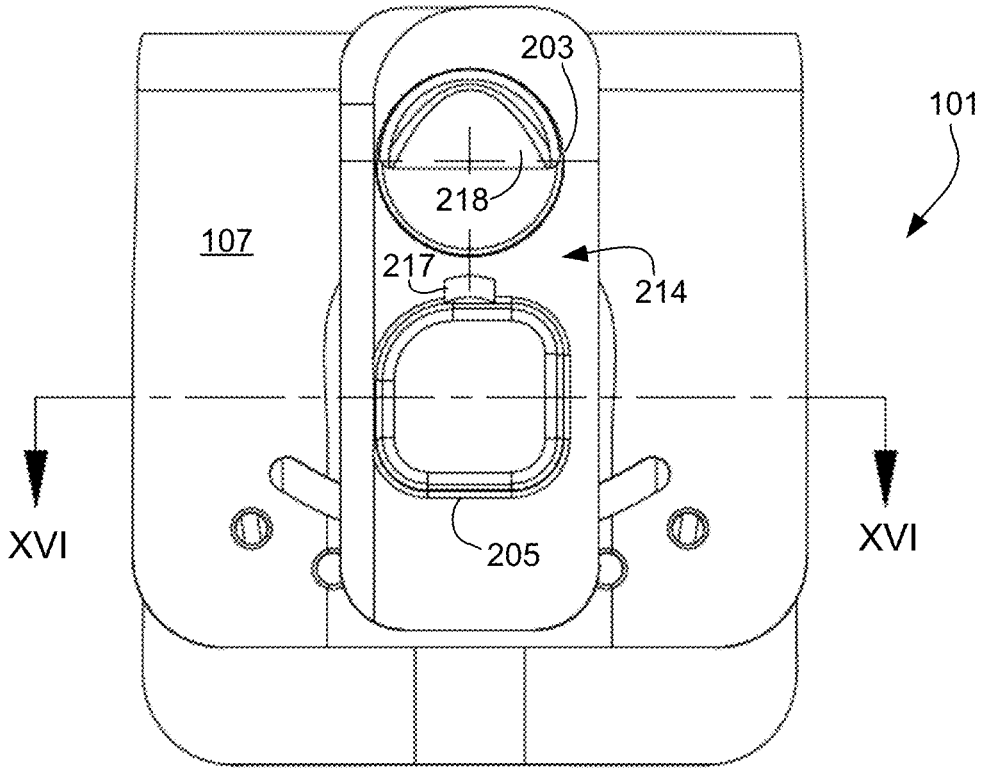
FIG. 15 is a front view of the pistol mount assembly of FIG. 10.
Figure 16:
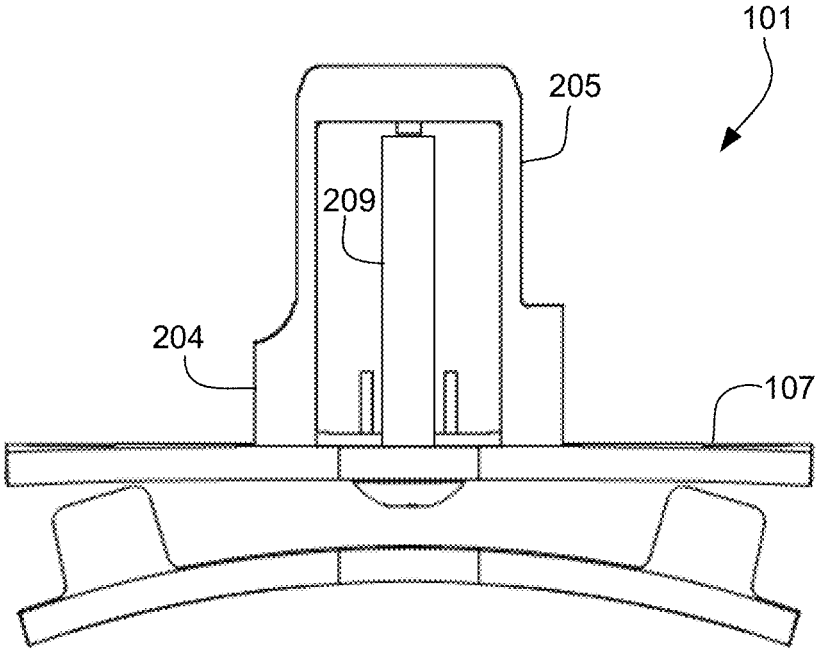
FIG. 16 is a section view of the pistol mount assembly of FIG. 15.

As this configuration assumes that latch assembly 203 cannot pass behind the trigger of the firearm, latch assembly 203 passes between the trigger and the trigger guard. Latch assembly 203 includes a rocker arm 203*a* configured to selectively pivot so as to overlap the trigger. Rocker arm 203*a* selectively operates between an extended position and a retracted position. As seen in FIG. 12, rocker arm 203*a* is retracted. Latch assembly 203 may include a latch interface 218 configured to allow manual operation of rocker arm 203*a*. Latch interface 218 may be a button on the top of latch assembly 203. Latch interface 218 may be a portion of rocker arm 203*a* that extends above latch assembly 203 as seen in the Figures. As seen in FIG. 14, rocker arm 203*a* may include a spring 220 to bias rocker arm 203*a* into an extended position when at rest. Therefore, activation of latch interface 218 would act to retract rocker arm 203*a* so as to not overlap the trigger and permit removal of the firearm.

It is understood that retaining body 104/204 are configured to be optionally detachable from clip body 107. Additionally, clip body 107 may include one or more apertures or slots to permit multiple orientations of retaining body 104/204 relative to clip body 107.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A pistol mount assembly, comprising:
a clip body;
a latch assembly coupled to an outer member of the clip body, the latch assembly includes a latch;
a locking cylinder coupled to the outer member of the clip body adjacent a locking assembly;
a guard channel formed outside of the latch assembly and the locking cylinder; and
a trigger channel formed between the latch assembly and the locking cylinder, the trigger channel also formed between the latch and the locking cylinder.

2. The assembly of claim 1, further comprising:
a locking bolt coupled to the locking cylinder, the locking bolt configured to selectively extend over the guard channel.

3. The assembly of claim 2, wherein the locking bolt is retractable.

4. The assembly of claim 2, further comprising:
a lock located within the locking cylinder, the lock configured to operate the locking bolt.

5. The assembly of claim 1, wherein the latch assembly includes a rotating latch configured to rotate between two orientations.

6. The assembly of claim 5, wherein the rotating latch is configured to selectively overlap the trigger channel in a first orientation.

7. The assembly of claim 5, wherein the rotating latch is configured to withdraw from the trigger channel in a second orientation.

8. The assembly of claim 5, wherein the rotating latch includes a tensioning device to bias the rotating latch to a singular orientation when at rest.

9. The assembly of claim 5, further comprising:
a locking bolt coupled to the locking cylinder, the locking bolt configured to selectively extend over the guard channel.

10. A pistol mount assembly for a firearm, comprising:
a clip body; and
a retaining body including:
a latch assembly;
a locking cylinder adjacent the locking assembly defining a channel therebetween; and
a locking bolt in communication with the locking cylinder, the locking bolt configured to selectively retract into and extend out from an exterior surface of the locking cylinder so as to selectively overlap the channel;
wherein the firearm passes within the channel; and
wherein the latch assembly and the locking bolt selectively restrict translating the firearm perpendicular to the clip body.

11. The assembly of claim 10, wherein the retaining body is detachable from an outer member of the clip.

12. The assembly of claim 10, wherein the locking bolt is retractable.

13. The assembly of claim 12, further comprising:
a lock located within the locking cylinder, the lock configured to operate the locking bolt.

14. The assembly of claim 10, wherein the latch assembly includes a rocker arm configured to selectively operate between an extended and retracted position.

15. The assembly of claim 14, wherein the rocker arm includes a spring to bias the rocker arm into an extended position.

16. The assembly of claim 15, further comprising:
a latch interface extending away from the latch assembly and configured to operate the rocker arm.

17. The assembly of claim 14, wherein the rocker arm and the locking bolt are on opposing sides of the latching assembly.

18. The assembly of claim 14, wherein the locking bolt extends outward over a side of the trigger guard.

* * * * *